US006691863B1

(12) United States Patent
Veenstra

(10) Patent No.: US 6,691,863 B1
(45) Date of Patent: Feb. 17, 2004

(54) EYEGLASS CASE WITH PEN HOLDER

(76) Inventor: Albertine Veenstra, 6300 Flotilla Dr., Apt. 104, Holmes Beach, FL (US) 34217

( * ) Notice: Subject to any disclaimer, the term of this patent is extended or adjusted under 35 U.S.C. 154(b) by 0 days.

(21) Appl. No.: 10/125,256

(22) Filed: Apr. 18, 2002

(51) Int. Cl.[7] ..... A45C 11/04

(52) U.S. Cl. ..... 206/5; 206/38; 206/371

(58) Field of Search ..... 206/5, 6, 38, 38.1, 206/224, 232, 371, 425, 581; 150/100, 106, 112; 281/30, 31; 402/79

(56) References Cited

U.S. PATENT DOCUMENTS

| | | | | | |
|---|---|---|---|---|---|
| 117,851 | A | * | 8/1871 | Abbott et al. | 28/30 |
| 1,559,551 | A | * | 11/1925 | Chivily | 206/215 |
| 1,648,565 | A | * | 11/1927 | Primley | 206/315.9 |
| D140,142 | S | * | 1/1945 | Jerry | D3/265 |
| 2,479,472 | A | * | 8/1949 | Coplon | 206/37 |
| 2,669,273 | A | * | 2/1954 | Keirsy | 190/115 |
| 3,232,397 | A | * | 2/1966 | McCoy | 190/110 |
| 3,647,056 | A | | 3/1972 | Jacobson et al. | |
| 3,850,352 | A | | 11/1974 | Reiner | |
| 4,161,201 | A | | 7/1979 | Carp | |
| 4,630,843 | A | * | 12/1986 | Willat | 281/30 |
| D310,301 | S | * | 9/1990 | Burrow | D3/265 |
| 4,966,318 | A | * | 10/1990 | Dutka | 224/411 |
| 5,006,699 | A | * | 4/1991 | Felkner et al. | 235/462.49 |
| 5,170,889 | A | * | 12/1992 | Cue | 206/232 |
| 5,379,929 | A | | 1/1995 | Eskandry | |
| D366,146 | S | * | 1/1996 | Bertrand | D3/249 |
| 5,718,023 | A | * | 2/1998 | Billish | 24/11 HC |
| D422,406 | S | * | 4/2000 | Dweck et al. | D3/247 |

* cited by examiner

*Primary Examiner*—David T. Fidei
(74) *Attorney, Agent, or Firm*—Young & Basile P.C.

(57) ABSTRACT

An eyeglass case of the fold-over envelope-type wherein a loop of elastic material is stitched into the interior of the case in the hinge or fold area to receive a writing instrument such as a ballpoint pen.

2 Claims, 1 Drawing Sheet

EYEGLASS CASE WITH PEN HOLDER

FIELD OF THE INVENTION

This invention relates to eyeglass cases and more particularly to an eyeglass case having the capability for carrying a writing instrument such as a ballpoint pen or mechanical pencil in a secure and convenient location within the case.

BACKGROUND OF THE INVENTION

Among the personal articles carried by many individuals are eyeglasses and writing instruments such as ballpoint pens and mechanical pencils. While these articles can be carried separately in a breast pocket, the better practice for carrying eyeglasses is to place them in a protective case. For convenience and to ensure an individual that he or she has both eyeglasses and a writing instrument with him or her at all necessary times, it is convenient to combine both eyeglasses and writing implements in a single carrier.

One previous effort toward this end is illustrated in U.S. Pat. No. 3,850,352 issued Nov. 26, 1974 to Lawrence Reiner. That patent discloses a rectangular eyeglass case having two parallel external pockets open at both ends for receiving and carrying writing instruments. Recognizing that it is not advisable to carry the case in a breast pocket with the writing ends of both implements protruding from the bottom of the respective pockets, Reiner proposes to carry the case on one's belt and provides a belt-loop for this purpose.

Another device of a similar nature but designed to be carried in a pocket is illustrated in U.S. Pat. No. 3,647,056 issued Mar. 7, 1972 to Arthur Jacobson et. al.

SUMMARY OF THE INVENTION

My invention is an improved combination eyeglass case and writing instrument holder wherein the writing instrument, for example a ballpoint pen, is securely held on the inside of the case with no portions thereof protruding from the case to any significant degree. My invention provides quick and easy retrieval of the writing instrument and can be carried safely and securely in a breast pocket or elsewhere.

In general, my invention comprises a closed eyeglass case, preferably an envelope-type eyeglass case of the type having a fold-over flap. To hold a writing instrument such as a ballpoint pen within the case yet in a position where it will not interfere with the primary purpose of the case, 1 mount a loop of elastic or resilient material within the case along the top of the eyeglass when placed in the case. In the preferred embodiment, the loop is made from elastic fabric and is stitched into the interior of the case in the hinge area. Preferably the loop is stitched into the case in an off-center position so as to work in conjunction with the pocket clip of a typical ballpoint pen or mechanical pencil.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
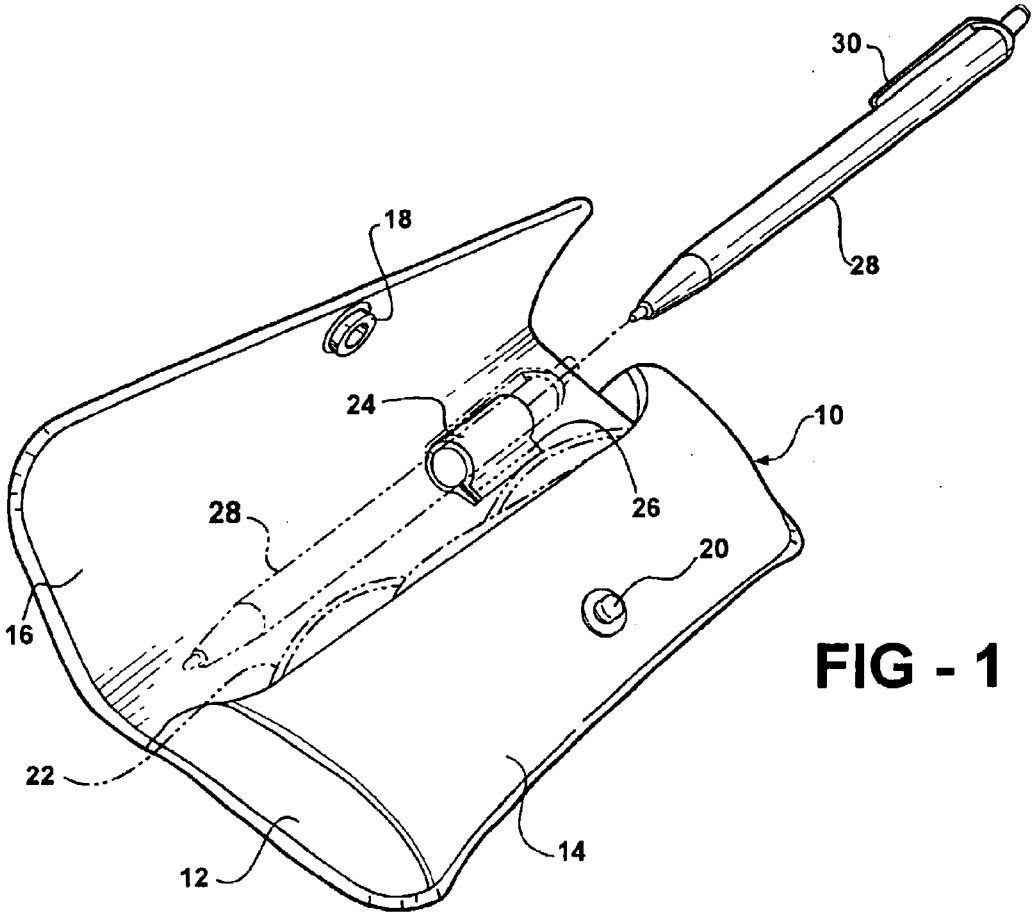
FIG. 1 is a perspective view of an eyeglass case designed and constructed in accordance with my invention.

Referring to the drawing, there is shown a leather eyeglass case 10 of the envelope-type having a pocket 12 with a front panel 14 and an extended back panel with a fold-over flap 16 having a female snap 18 cooperable with a male snap 20 mounted on the front panel 14. The size and shape of the case 10 is such as to receive and hold a pair of conventional eyeglasses 22 in the folded condition therein. The flap 16 can be folded over to close the case and lock by means of the snap fittings 18, 20.

In accordance with my invention, a loop 24 of elastic fabric material is stitched to the panel 16 in the hinge area as shown in FIG. 1 to receive and hold a ballpoint pen 28. One or two rows of stitches 26 are made through the elastic material of the loop 24 and the back portion of the panel 16 to hold the loop in place. The width of a typical eyeglass case is 6" whereas the length of a typical ballpoint pen is about 5 ¼". Accordingly, the pen 28 fits entirely within the case 10. the center of loop 24 is displaced about 1 ½" to the right of center also as shown in FIG. 1. The diameter of the barrel of a conventional ballpoint pen 28 typically runs from approximately ⅜" for a Lamy® or Montblanc(g pen to just over 1/4" for narrower brands such as Cross®. Loop 24 is preferably made just under ¼" in diameter such that the elastic material is forced to expand somewhat when the pen 28 is inserted into the loop. If desired the loop 24 may be made in two or more sizes identified by size indicators such as "medium" and "large" for pens of different sizes. The off-center location of the loop 24 is such as to permit the loop to receive and cooperate with the pocket clip 30 which is mounted on the upper "clicker" end of the ballpoint pen 28.

Figure 2:
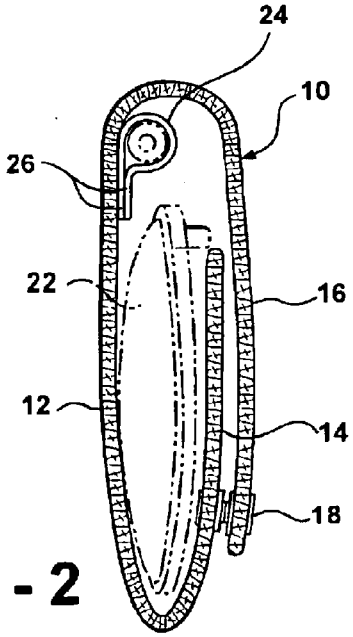
FIG. 2 is a sectional view through the eyeglass case of FIG. 1 showing the location of eyeglasses and other components of my invention within the case.

When the eyeglasses 22 and pen 28 are in the case 10 together, the pen 28 lies just above the eyeglasses 22 as best shown in FIG. 2. I have found that little or no interference occurs when the pen is closer to the top of the eyeglasses; possibly even in slight overlapping contact therewith. The pen 28 is fully within the width of the case 10 such that even with the ballpoint in the exposed condition the pen posses no threat of ink stains on the user's shirt when the combination is placed in a breast pocket. The pen is easily retrieved simply by unsnapping the panel 16 of the case 10 and pulling the pen out along its longitudinal axis.

Although somewhat less advantageous, the loop 24 can be located in the center of the case; I prefer to mount it off-center where it will cooperate with the pocket clip 30 as shown. The loop 24 is preferably formed of elastic fabric material such as is used in the waist band of garments, on the order of 1" in width. However the loop 24 may be formed of other diverse materials such as resilient plastic in which case the loop 24 may not necessarily be a complete 360°; i.e., the loop may be more in the nature of a 270 °clip receiving the pen 28 therein and maintaining it within the case 10.

I have also found that my invention works equally well with cases which do not have snap locks; i.e., simple pocket or fold-over designs as well as more expensive cases having spring biased fold-over flaps work equally well with my invention.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An eyeglass case comprising a pocket portion of such size and shape for receiving and storing foldable frame eyeglasses therein in a folded condition;

said pocket portion having a front panel approximating the width and height of a pair of foldable frame eyeglasses and a rear panel spaced from the front panel by approximately the thickness of a pair of foldable frame eyeglasses and secured to the front panel along the sides and bottom of said pocket to define an eyeglass storage volume between the front and rear panels, said rear panel having a flap extension which folds over the first panel along a rounded fold area to close the pocket; and a loop of elastic material secured to the interior of the case in the fold area to receive and hold a writing instrument substantially wholly within the case and in and parallel to the fold area above the eyeglass storage volume.

2. The device of claim 1 wherein the loop of elastic material is fabric and is secured by stitching in the interior of the case longitudinally off-center along the fold area.

* * * * *